US006639515B2

(12) United States Patent
Hougaard

(10) Patent No.: US 6,639,515 B2
(45) Date of Patent: Oct. 28, 2003

(54) SURVEILLANCE SYSTEM FOR ADVERSE EVENTS DURING DRUG DEVELOPMENT STUDIES

(75) Inventor: Philip Hougaard, Virum (DK)

(73) Assignee: Novo Nordisk A/S, Bagsvaerd (DK)

( * ) Notice: Subject to any disclaimer, the term of this patent is extended or adjusted under 35 U.S.C. 154(b) by 169 days.

(21) Appl. No.: 09/975,814

(22) Filed: Oct. 11, 2001

(65) Prior Publication Data

US 2003/0128120 A1 Jul. 10, 2003

(51) Int. Cl.[7] ..... G08B 23/00
(52) U.S. Cl. ..... 340/573.1; 424/9.2
(58) Field of Search ..... 340/573.1, 3.1, 340/3.3; 424/9.2, 10.1; 600/300, 301

(56) References Cited

U.S. PATENT DOCUMENTS 6,108,635 A * 8/2000 Herren et al. ..... 705/2
6,204,767 B1 * 3/2001 Sparks ..... 340/573.1
6,366,206 B1 * 4/2002 Ishikawa et al. ..... 340/573.1
6,566,063 B1 * 5/2003 Kaufmann et al. ..... 435/6

* cited by examiner

*Primary Examiner*—Toan N Pham
(74) *Attorney, Agent, or Firm*—Reza Green, Esq.; Richard W. Bork, Esq.; Marc A. Began, Esq.

(57) ABSTRACT

A method for clinical surveillance of a treatment group and an other group involves defining an adverse event, possible a serious adverse event, noting each occurrence of the adverse events, and, starting at zero, calculating a cumulative sum of the adverse events by updating the cumulative sum each time a further adverse event is reported and, when the adverse event is in the treatment group, adding 1 to the cumulative sum, and, when the adverse event is in the other group, adding 0 to the cumulative sum. This invention also involves subtracting a chosen quantity K from the cumulative sum, comparing the cumulative sum to a predetermined alarm limit, determining when the cumulative sum reaches at least the predetermined alarm limit, and indicating the predetermined alarm limit has been reached.

20 Claims, 5 Drawing Sheets

SURVEILLANCE SYSTEM FOR ADVERSE EVENTS DURING DRUG DEVELOPMENT STUDIES

FIELD OF THE INVENTION

This invention relates to the monitoring of drug development studies, such as phase III drug development studies, for adverse effects, and more particularly, to a system for detecting when the number of adverse effects becomes excessive.

BACKGROUND OF THE INVENTION

Phase III of a clinical development program involves the large-scale application of the new drug to patients (the desired effect of the drug is evaluated in phase II). The aim of a phase III study is to confirm the efficacy of the recommended dose of the final formulation and to evaluate the risk of adverse events. Adverse events can include those that are expected from observations made during earlier study work on the drug, as well as those adverse events which are unexpected. Typically, the studies in this phase are double-blind comparisons of the new drug versus a control, which is a placebo, or, alternatively, the best existing product. In this phase, many new side-effects are detected. Phase III studies are performed in order to assess the risk of frequent adverse events.

It may be necessary to close the project if too many patients experience adverse events, particularly if they are serious adverse events. The risk of rare and severe adverse events cannot be assessed with sufficient precision, but the events must be monitored in order to stop the trials if there is a major safety problem.

Although studies of this type can involve thousands of patients, such studies may nevertheless be underpowered for evaluating the more serious and rare events. However, there still is a need to monitor these events, and if they are too frequent, the drug development program needs to be stopped.

Typically, in these studies there is an expedited reporting system allowing the clinical centers to report serious adverse events to a drug company safety officer, who in turn may report such events to the authorities. Additionally, there might be a safety committee to initiate a detailed examination of suspected side effects, and to take decisions and/or make recommendations to the management, in case drug safety is compromised.

The standard safety measures are, however, not satisfactory because they have few formal methods to base their decisions upon. One reason for this is that at least some types of adverse events may be unexpected, and some sort of categorization of diagnoses is needed. Another reason is the blind nature of phase III testing. Technically, it would be preferable to include all patients accounting for the actual treatment, but this might lead to suspicions on the integrity of the blinding of the studies. Furthermore, this approach may not be practical, because the data flow for patients not suffering from the adverse events is markedly slower. A third difficulty is the sequential nature of the problem, making statistical methods intrinsically more complicated.

Examples of surveillance systems for monitoring health-related programs include: Chen, R., "A Surveillance System For Congenital Malformations", J. Am. Statist. Assoc. 1978; 73: 323–327; Gallus, G., et al. "On Surveillance Methods For Congenital Malformations", Statist. Med. 1986; 5: 565–571; Lie, R.T., et al., "A New Sequential Procedure For Surveillance of Down's Syndrome", Statist. Med. 1993; 12: 13–25. These references describe systems for monitoring birth defects, and they provide that after an alarm has occurred, action such as a warning requiring a detailed investigation be taken. These papers study an overall response, that is, observations are not split in subgroups, like treatment.

Other references of general interest include Lucas, J. M. "Counted Data CUSUM's", Technometrics, 1985; 27: 129–144; Brook, D., et al. "An Approach to the Probability Distribution of CUSUM Run Length", Biometrika 1972; 59: 539–549; and Wald, A., "Sequential Analysis", New York: John Wiley and Sons; 1947.

Another article of interest is Bolland, et al. "Formal Approaches to Safety Monitoring of Clinical Trials in Life-Threatening Conditions", Statist. Med. 2000; 19:2899–2917. This paper describes the application of a binomial sequential test among deaths in a clinical trial; comparing the proportion with ½, the proportion of patients randomized to the experimental treatment.

Surveillance of tests such as phase III trials is important to insure the overall health of the many patients involved, the concerns of the doctors and authorities involved, and the substantial time and expense of such testing. Monitoring of trials is also important to reduce the likelihood of the administering drug company being sued if there is a problem.

No satisfactory approach for the clinical surveillance of testing programs was found in the literature.

SUMMARY OF THE INVENTION

A new, simple approach to surveillance of adverse events, and more particularly, serious adverse events, during phase III is suggested (phase III studies are typically double blind comparisons of the drug with placebo, or a control, performed in order to assess the risk of frequent adverse events).

Although the present invention is described in the context of a phase III study, this invention is not to be limited thereto. It should be understood that, given the teachings in this application, those skilled in the art would understand the present invention also is applicable to other parts of drug development studies such as Phase II and IV, and even to other types of studies.

The present invention provides for the expedited reporting of adverse events, and such reporting can involve the entity administering the testing, and/or the authorities.

Although this invention is phrased in terms of serious adverse events, it also relates to the monitoring of other adverse events. Those skilled in the art will understand that the same procedures could be used for both serious and other adverse events, and so the use herein of one or the other of those expressions should be understood to encompass both types of events.

The present invention involves a CUSUM approach, where the events in the treatment group are cumulated, adjusting for the expected numbers based on the total number of adverse events. Thus, if there are many events in the treatment group compared to the control group, there will be an "alarm". In response, the procedure "unblinds" the treatment for serious adverse events, but no other information is revealed from the ongoing studies.

The exact probability properties of this sequential Bernoulli procedure can be evaluated by means of Markov chain methods. Optimizing the surveillance program with respect to the mean time to alarm (the standard in CUSUM applications) leads to a design that depends on the alternative considered, whereas the optimum solution based on the probability of alarm within the expected course of the study is independent of the alternative.

The procedure was applied to adverse events for a drug known as NNC 46-0020, a partial estrogen receptor agonist. A finding of too many adverse events led to closure of the product.

Other features and advantages of this invention will become apparent in the following detailed description of preferred embodiments of this invention, taken with reference to the accompanying drawings.

DESCRIPTION OF THE PREFERRED EMBODIMENT

Figure 1:
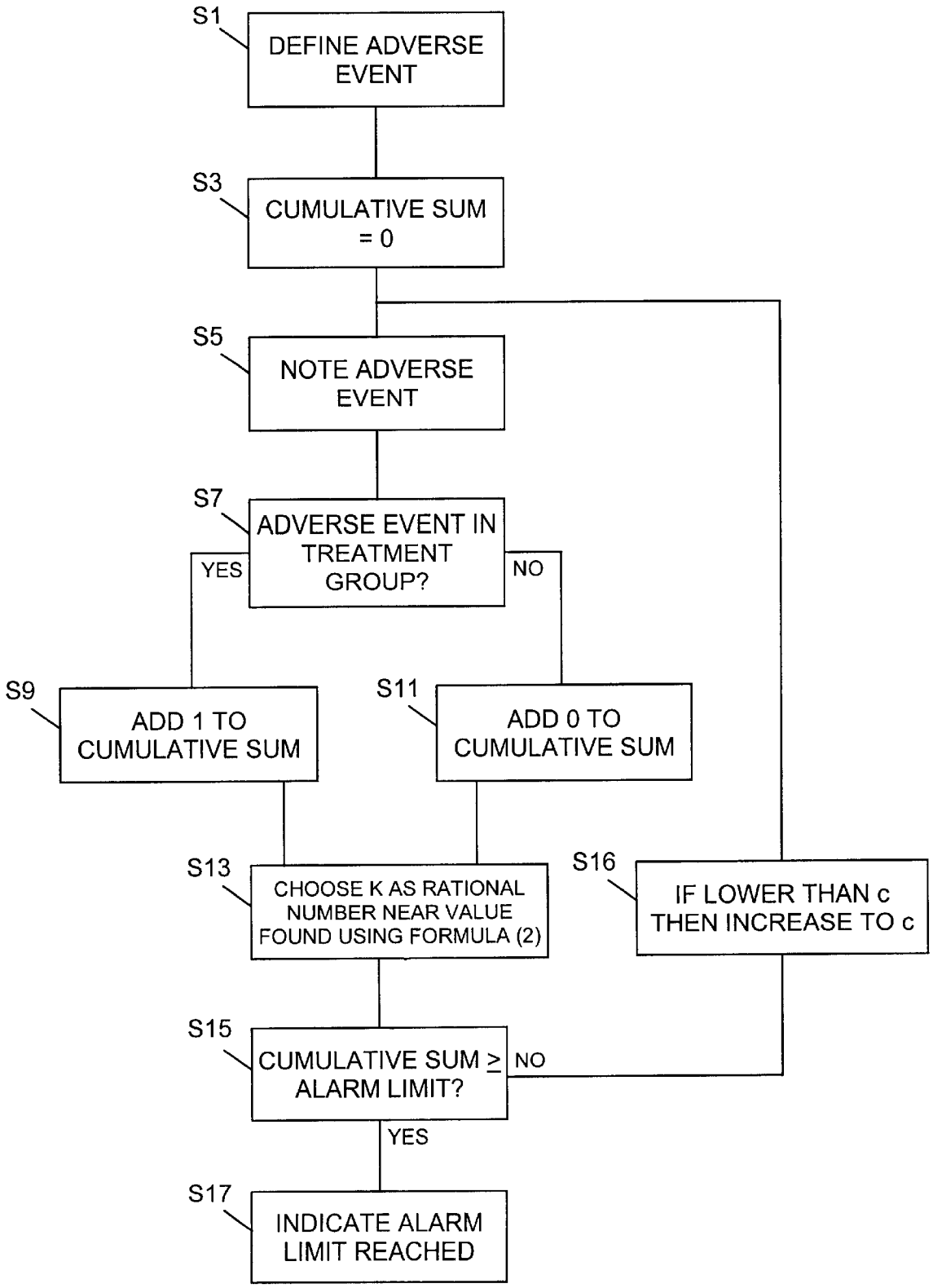
FIG. 1 shows a clinical surveillance process.

The present invention describes a simple and practical procedure for monitoring phase III studies and, when significant adverse effects are detected, unblinding only the patients with serious adverse events, accounting for the sequential nature of the problem.

Even though the problem of adverse effects during phase III testing is sequential in nature, the recommended solution is not a sequential test. Such a test is designed to decide whether a given null hypothesis or a given alternative regarding the primary endpoint is satisfied, in order to conclude the trial as fast as possible. With regard to adverse events, however, the study program as such is fixed. There is no primary endpoint, but many different adverse events are considered. Thus, even if the conclusion is reached that there is no difference in risk with regard to a specific type of adverse event, the study cannot be closed, because there still is a need to consider other types of adverse events. As the study is continued, it makes no sense to make a fast conclusion that there is no difference. If the true risk were slightly elevated, there could be a fair probability of an early conclusion saying that there is no difference, but the information collected afterwards might make it possible to detect the difference. Therefore, there is a need for a procedure which issues a warning if there is an increased risk, but which does nothing in the situation where risk is not increased.

The present invention accomplishes this by monitoring, rather than using a significance test. In other words, whereas the sequential test at any time point has three possible actions ((1) stop due to a difference, (2) stop due to no difference, or (3) continue), a surveillance program only has two actions ((1) stop due to difference, or (2) continue). Furthermore, only increased risks are relevant. If the risk is decreased, it is an advantage of the product, but phase III testing must nevertheless be continued in order to evaluate whether there are any other adverse events.

Next, general issues relating to surveillance methods for use with phase III studies will be considered.

In phase III studies, it is desirable to monitor drug safety in detail, since many patients are exposed to the drug, and there still is a risk of serious unexpected adverse events. Therefore, it is common to have a safety committee which is responsible for observing the adverse events and reporting on them, in cases where serious events are found. Before a monitoring program is set up, however, it is necessary to, make decisions regarding the diagnoses to be covered, the degree of unblinding to be performed, and the comparison to be made.

The diagnoses covered should be considered in order to avoid having to discuss classification at a later time, and also to avoid mass-significance considerations. The present invention works for covering all adverse events classified as serious. In one of the examples discussed below, cases of prolapse and incontinence are addressed. Although these events are not classified as serious, an expedited reporting system was still set up in order to monitor those events.

It also is necessary to consider what information should serve as a basis for unblinding of treatments. It is known that there are 3 possibilities; no unblinding is performed, partial unblinding, i.e., of the patients suffering the actual adverse event, is performed, or full unblinding, i.e., of all patients in phase III, is performed.

Another point to consider in a study is which comparison (s) to perform, i.e., should the drug being tested be compared to the control, to an external (literature-based) estimate, or should the drug combined with the control be compared to an external estimate.

Accordingly, there are three ways to perform evaluations where adverse events are encountered.

First, one can choose not to unblind the study, in which case the only possibility is to compare the total (i.e. irrespective of treatment) number of adverse events with an external estimate. One advantage of this external estimate approach is that random error is small and it can be determined before start of the trials. This approach also allows for a two-stage procedure, where the second stage unblinds the adverse event cases and compares the two treatments (and this comparison is uncorrelated to the comparison with the external estimate). This approach does, however, have several disadvantages, the major one being a possible lack of representativity. Patients entering a trial are often selected by being recruited at hospitals. This means that the patients having mild cases, who are likely only to consult with their general practitioner and not go to the hospital, will not be recruited, and so such mild case patients are often not represented in a study. On the other hand, the most seriously ill patients might not be considered for inclusion because of their condition; of course, this will in part depend upon the drug being examined. It is also a challenge to define diagnoses where official statistics are available in sufficient detail, comparable over countries, and relevant for the disease under study, and the patient study population with the appropriate inclusion/exclusion criteria. The focus on health at the trial initiation can lead to earlier reporting and/or over-reporting of adverse conditions. This approach further requires an estimate, say each week, of the number of years of observation time for patients in the studies. In summary, it is presently felt that the disadvantages of this approach outweigh its advantages.

In the second approach, partial unblinding (case unblinding) can be performed, and it is presently believed that this approach may be the most sensible. The procedure is based on a comparison between the drug and the control among patients experiencing the adverse event. This is statistically valid for rare events, except in cases with a differential drop-out, and under-reporting of events. The proportion on the two treatments among patients with adverse events should follow the proportion randomized to the treatments, and the evaluation can be based purely on the information available to the department in charge of drug safety. This approach, incidentally, was used in the Bolland paper.

Thirdly, unblinding of all study participants will allow for a more refined analysis, accounting for the treatment and length under study at the individual level, for example, using survival data methods. However, this approach, unblinding all patients, is not presently preferred because of the consequences for study integrity and because study length data at the individual level might arrive slower than the information on serious adverse events.

Even though the drug versus control comparison approach is preferred, it is not believed that this approach by itself is sufficient, especially with regard to diagnoses that are rare for untreated patients. For example, if the trial treatment is a double dummy comparison, say, evaluating the nasal administration of a drug versus injection of that drug, and the treatment group develops a number of nasal adverse events, known to be uncommon to patients with that disease, then one should compare the treatment group to a historical (external) estimate. In this way the program can be stopped earlier than would have been possible if one were to wait for the control group to collect enough observation time to prove that the nasal condition is rare. This drug versus external estimate comparison makes sense only for large effects, relative to the possible error due to lack of representativity, and is difficult to formalize.

After an alarm has occurred, a number of actions can be taken. The alarm can be treated as a warning, resulting in a detailed investigation: Such an approach has been used for the monitoring of birth defects, as described in the references to Chen, Gallus and Lie. These references describe systems for monitoring birth defects, and they provide that after an alarm has occurred, action such as a warning requiring a detailed investigation be taken. It is then natural to restart the process at 0, that is, measure the time from this moment, and only consider future events. Another possibility is to consider the alarm to be a decision to stop the program.

Whether the alarm should be considered a warning or a decision ending the program should be specified in the protocol, and the choice has major importance for the choice of specifications for the surveillance program.

It is indeed possible to have a double program, including both a warning and a decision level, by having common values of K, and separate values of H. H and K are the parameters of the procedures, and will be defined below.

Various aspects of the present invention will now be shown with reference to FIG. 1.

One or more adverse events are defined in step S1. The present invention involves a cumulative sum (CUSUM) approach, which starts at 0, as shown in step S3. Adverse events are noted in step S5. An inquiry is made in step S7 whether the event is in the treatment group or the other group. If the event is in the treatment group, 1 is added as in step S9, otherwise 0 is added in step S11. Then in step S13 a chosen quantity K is subtracted from the cumulative sum. This K serves as a correction for the expected increase, although it does not need to be identical to the expected value (K acts as a correction for the mean increase in event count, but it may be advantageous to use a slightly higher value).

A check is made in step S15 whether the cumulative sum has reached an alarm limit. If so, then in step S17 an indication is given that the alarm limit has been reached. If not, then processing returns back to step S5, where the next adverse event is noted. In step S16, it is determined whether the cumulative sum is less than c, and if it is lower than c, then it is increased to c.

By such looping the cumulative sum value is updated each time a new serious adverse event is reported.

H is chosen to make the risk of false alarm (alarm where there is no safety problem) low. H is highly dependent upon K. A lower limit c (negative or 0) for the process can be applied. If the value crosses a chosen positive limit H, then this is treated as an alarm, suggesting there is increased risk for the treatment group. The parameters K and H determine the specifications of the approach, and should be chosen accordingly.

In mathematical terms, the procedure can be written in the following way, where i is the event number and $S_i$ denotes the cumulative sum:

$$S_0=0$$

$$S_i=\max\{c,S_{i-1}+N_i-K\},\ i=1,2,\ldots \tag{1}$$

where $N_i$ is the indicator function of the ith event being in the treatment group.

The alarm event is the first event number (i) with $S_i \geqq H$. Finally, $-\infty \leqq c \leqq 0$ is a chosen constant.

Figure 3:
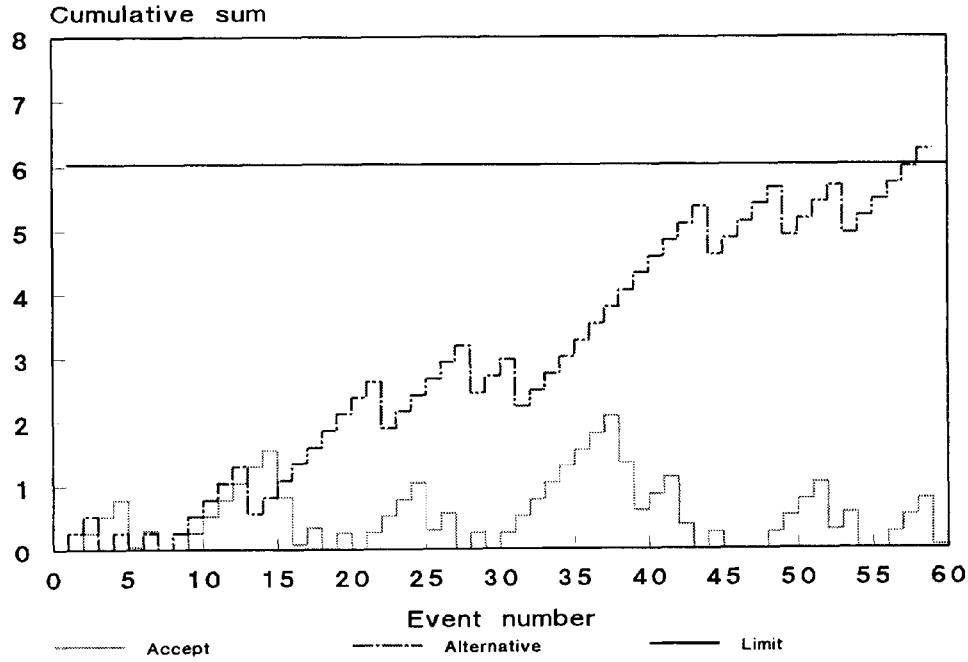
FIG. 3 depicts a simulated course under the acceptable proportion (2/3) and the alternative proportion (4/5), for 60 events, for a design with K=0.74, H=6.04 and c=0.

To illustrate this approach, two simulations have been performed for the same design using two different probabilities, as depicted in FIG. 3. The values for the application, were chosen such that K=0.74, H=6.04, c=0 and probability p=2/3 (solid thin line), this being the proportion randomized to the treatment group, and probability 4/5 (dashed thick line), which is the proportion used as alternative. The process was simulated for 60 events, which was the expected number of adverse events. Under the acceptable probability 2/3, no alarm is seen within 60 events, but under the alternative probability 4/5, an alarm is signaled after 58 events.

The constant c may simply be chosen to have value 0, in which case the memory of the process is limited. Alternatively, it can be chosen to be negative, which is mathematically identical to a so-called fast initial response (this itself is suggested by Lucas, J. M., "Counted Data CUSUM's", Technometrics 1985: 27: 129–44). The reason there is such a lower limit is that one wants to be able to detect a suddenly increased risk. That is, there are situations where there is initially no difference, but then after some time an increased risk develops. This situation is difficult to detect with a negative lower limit, in particular, when $K>p_0$.

The choice of c will now be discussed.

It is possible to use $c=-\infty$, that is, remove the lower limit completely, but then exact calculation of the mean time to alarm is no longer possible. In fact, the mean is finite only when p>K. The exact distribution can be evaluated because at any finite time point, the number of possible states is finite. So in practice, c can just be chosen to have a large negative value and the exact calculations can be used.

In the case where K equals p, the expected value, the procedure has an interpretation as a cumulative sum of residuals in a Bernoulli model, with the modifications that there is a lower limit of 0, and that there is an upper limit, which leads to an alarm, when reached. If $c=-\infty$, the alarm time is a stopping time in a martingale.

This approach is inspired by Poisson based CUSUM methods (as described in Lucas' article "Counted data CUSUM's", Technometrics, above), already discussed in a frame of the risk of birth defects. Such a CUSUM process is evaluated at regular calendar time intervals. The time unit is defined so that the intervals have length 1. The number of birth defects $N_i$ in the ith period is assumed to have a Poisson distribution, with a mean, say $\lambda$, which is the product of the number of births and the probability of birth defect for a single birth. Variation in the number of births are not accounted for, however, and thus only a historical value of $\lambda$, say $\lambda_0$, is used for the acceptable number of birth defects in a period. Thus the aim is to detect a possibly increased incidence of adverse effects in order to react quickly.

The procedure suggested here differs in three respects. First, two treatments (drug and control) are compared. Second, there is a conceptual difference in that the time scale is the discrete time scale of reported serious adverse events in the trials. Third, there is a technical difference in that $N_i$ is Bernoulli distributed with probability p, rather than Poisson distributed. Also here, there is an acceptable value for p, say $p_0$, which in the drug surveillance case typically is the proportion randomized to receive the treatment.

Nevertheless, there are sufficient similarities so that it is possible for those skilled in the art to modify appropriate existing software for handling the Poisson case to handle the Bernoulli case.

This approach is designed for rare events. If, however, events are common in one group, the probability of observing some in the other group will increase due to there being more event-free individuals in that group.

The specifications are determined by the values of H and K.

One key quantity is the risk of concluding that there is difference, when there is, in fact, no difference. This corresponds to the significance level in statistical tests. This is denoted as the risk of false alarm. Generally, this is a complicated function of H and K, but in practice, it means that one parameter (K) is available for optimization, and then H is determined as the smallest value satisfying the requirement on the risk of false alarm. Generally, the value of H is highly dependent on K.

For some evaluations, it is important to consider a specific alternative. Here, alternatives are only considered corresponding to increased risk. The probability, $p_1$, is derived from the alternative value of the relative risk of r, as $p_1=p_0 r/\{p_0 r+(1-p_0)1\}$.

Exact calculations for this procedure are readily calculated when $c>-\infty$, using the observation of Brook and Evans in their article "An Approach to the Probability Distribution of CUSUM Run Length", Biometrika 1972; 59: 539–49, that in the case of K rational, the CUSUM process is a finite state homogeneous Markov chain. If K=r/q, r and q integers, H can be chosen to be equal to h/q, h integer, and c as −u/q, u a positive integer and the possible values for $S_i$ are −u/q, (1−u)/q, . . . , 0, 1/q, . . . , h/q, giving a total of u+h+1 states. In the Bernoulli case, each state can lead to only two other states, according to whether the next event is in the treatment or the control group. The final (alarm) state (h/q) is absorbing. The time to reach this state is a stopping time. A simple example illustrates the idea.

Let $p_0$=K=2/3, H=5/3 and c=0. This gives 6 states and the transition matrix G is as shown in Table 1 below:

TABLE 1

| | State at time i | | | | | |
|---|---|---|---|---|---|---|
| State at time i-1 | 0 | ⅓ | ⅔ | ⅓ | ⅓ | ⅔ (alarm) |
| 0 | ⅓ | ⅔ | 0 | 0 | 0 | 0 |
| ⅓ | ⅓ | 0 | ⅔ | 0 | 0 | 0 |
| ⅔ | ⅓ | 0 | 0 | ⅔ | 0 | 0 |
| ⅓ | 0 | ⅓ | 0 | 0 | ⅔ | 0 |
| ⅓ | 0 | 0 | ⅓ | 0 | 0 | ⅔ |
| ⅔ | 0 | 0 | 0 | 0 | 0 | 1 |

Again, Table 1 is the transition matrix (G) for $p_0$=K=2/3, H=5/3 and c=0.

With continued reference to Table 1, each row gives for the corresponding value of the CUSUM process the probability distribution of the process in the next step. The n-step transition matrix is $G^n$, the matrix G raised to the power of n. As the process is started in state 0, the u+1'th row of $G^n$ gives the distribution of the state after n adverse events. In particular, the last element of the u+1'th row equals the probability of an alarm within n adverse events. Calculations will be correct even if r, u and q have common divisors, but computations will be inefficient. A change from $p_0$ to $P_1$ changes the positive values of G, but the zeroes will be unchanged. A further result obtained by Brook and Evans in their article "An Approach to the Probability Distribution of CUSUM Run Length", mentioned above, is that the mean time to alarm can be found by solving the matrix equation $(I-R)\mu=1$, where I is an identity matrix of dimension u+h, R is the matrix obtained by deleting the last row and column of G and 1 is an u+h-vector of 1's. The result $\lambda$ is a vector of mean times to alarm, each component corresponding to an initial state. At the start in state 0, there is interest in the u+1'th element of $\mu$. By solving a further matrix equation, the variance on the time to alarm can be found. Using these results provides both the exact distribution, and the mean and variance of the time to alarm. Computing time increases with the square or cube of u+h=(H−c)q, and therefore it is a major advantage to have a low value of q. The software used for this purpose can handle several thousand states. By way of non-limiting example, such software can be prepared by those skilled in the art using a commercially available computer language such as APL+Win to perform the evaluations. These evaluations also could be performed using other computer languages, but it is facilitated by a system that is good at handling vectors and matrices.

Two different definitions of the risk of false alarms will be considered for optimizing the approach. The standard definition is the mean time to alarm (so-called "average run length"). For Poisson based CUSUMs, this has been derived by its relation to the sequential probability ratio test such that the theoretically optimal value for K is $(\lambda_1-\lambda_0)/(\log \lambda_1-\log \lambda_0)$, where $\lambda_1$ is the alternative value for $\lambda$, as can be seen in Wald, A. "Sequential Analysis", John Wiley & Sons, New York (1947). For practical purposes, this function can be approximated by the midpoint between $\lambda_1$ and $\lambda_0$. In practice, there is some discreteness in the problem, meaning that the optimum might not be exactly at that value. In the Bernoulli case the similar formula is:

$$K=-[\log\{(1-p_0)/(1-p_1)\}]/\log[p_0(1-p_1)/\{p_1(1-p_0)\}]. \quad (2)$$

This optimum is close to the average of the two probabilities. The expected time to alarm might make sense for a study such as an ongoing study of birth defects in a population, but the finite time frame for a phase III program implies that the most important parameter is the probability that the program be stopped prematurely because of safety problems. To be precise, this probability is evaluated as the probability of an alarm before reaching the expected number of adverse events during the study program. Using this quantity for optimization implies that the optimal value for K is $p_0$, the expected value. It makes for a simpler interpretation to have K equal to the expected value. It may be possible to avoid having to consider a specific alternative, and calculations are simpler, because often $p_0$ is a simple fraction. However, a low value of K is less robust to errors in the expected number of events during the study.

Figure 4:
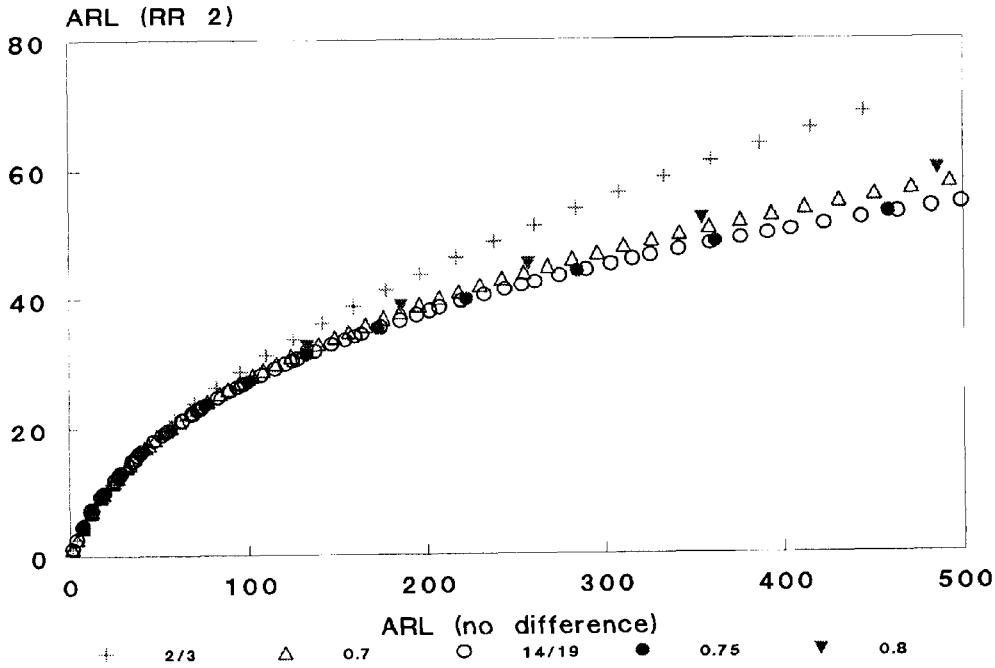
FIG. 4 shows combined values for an average run length under the acceptable proportion (2/3) and the alternative proportion (4/5) for various choices of K, with c=0.
Figure 5:
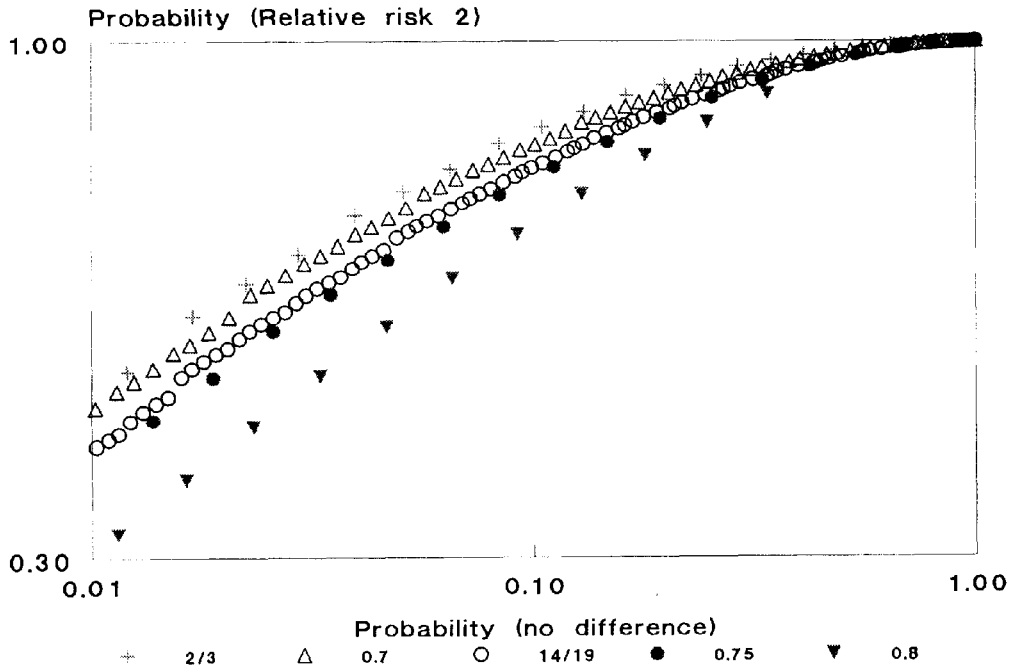
FIG. 5 illustrates combined values for probability of alarm within 60 events under the acceptable proportion (2/3) and the alternative proportion (4/5) for various choices of K, with c=0.

These points will be illustrated by comparing the performance of various surveillance system designs. For values of K of 2/3, 0.7, 14/19, 0.75 and 0.8, all possible values of H up to a chosen limit are considered and simultaneous values of $ARL_0$ and $ARL_1$ are evaluated, using probabilities of 2/3 and alternative 4/5 and c=0. These are shown in FIG. 4. The best performance is generally obtained for K=14/19 (=0.7368). The Bernoulli theoretically optimal value for discriminating between values 2/3 and 4/5 is 0.7370. Alternatively, one can compare the designs using the probability of alarm within 60 events. This is shown in FIG. 5. It is clear from FIG. 5 that there is a monotone effect of K, so that K=2/3 is optimal. The sensitivity to the choice of number of adverse events is illustrated in the application.

Example 1 Phase III Testing of NNC 46-0020

The present invention was used to test a particular drug compound, NNC 46-0020, which was designed to protect healthy women from getting osteoporosis. NNC 46-0020 is a partial estrogen receptor agonist, and had passed phase II trials without major problems regarding adverse events.

Phase III consisted of studies including 3000 women. The inclusion criteria were extended so that the women were older than those participating in phase II. Subjects were randomized to take either a placebo or NNC 46-0020 in one of two doses. The surveillance procedure did not account for the dose, and thus it was presumed that 2/3 of the patients received the drug and ⅓ receive placebo. As explained in detail below, this product has motivated the choice of parameters in the examples.

Early in phase III, a number of reports of prolapses and urinary incontinence were received. It was suspected that there were too many cases of prolapses and incontinence. Therefore, it was decided to set up a surveillance program, including expedited reporting of the events even though they are not classified as serious adverse events. Furthermore, investigators were instructed specifically to check for these types of events.

First, it was decided to set up separate programs for prolapses and incontinence, but later the etiology was suspected to be the same and therefore a combined program was used. The incidence of these events is poorly documented in the literature. There are a few reports on the prevalence and based on these, an incidence of 1%/year for each type of adverse event was chosen. This gives an estimated 60 events during the first year of the trial, distributed with 40 in the treatment group, and 20 in the placebo group. An alternative considered was to have a relative risk of 2, corresponding to an expected number of 100 events, namely 80 in the treatment group and 20 in the comparison group. This amounts to an alternative value of the probability of $p_1$=4/5. The lower limit c was chosen as 0.

As will be explained in detail, the high number of adverse events on this product, as documented by the statistical procedure, led to early closure of the product at a time when about 3000 women were in the study program.

For optimization, selected K values in the interval from $p_0$ to $p_1$ were considered. Values outside this interval were not relevant. For doing the exact evaluations, it is preferable to write K as a rational number r/q, where q is as small as possible. On the other hand, a high value of q implies that the possible H values are closer and thus it might be easier to find H to give a probability of stopping early close to the intended. Thus, the values 2/3, 3/4 and 4/5 stand out as the most simple. Also 0.7 is acceptable, and to a lesser extent 0.72 and 0.74. The value 0.73 also was included, but this is computationally more cumbersome. Other, more odd values of q in the interval, such as 14/19, also were tried.

For a drug company, the key quantity is the probability of stopping drug development due to safety problems. The drug company might require that the probability of an alarm within the study program should be less than 1% if there is no difference between the treatment and the control. Therefore H was found so that the probability of obtaining an alarm within 60 adverse events is below 0.01.

These probabilities are shown in Table 2 using both 60 and 100 as expected events. Table 2 reflects design choices with $p_0$=2/3, $p_1$=4/5 and c=0. H is the smallest value satisfying that the probability of alarm within 60 events under $p_0$ is below 0.01:

TABLE 2

| K | H | Probability of alarm within 60 events. p = ⅔ | Probability of alarm within 60 events. p = ⅘ | Probability of alarm within 100 events. p = ⅘ |
|---|---|---|---|---|
| ⅔ | 9.67 | 0.0089 | 0.4231 | 0.9041 |
| 0.7 | 7.9 | 0.0092 | 0.4127 | 0.8446 |
| 0.72 | 6.88 | 0.0099 | 0.3972 | 0.8029 |
| 0.73 | 6.43 | 0.0099 | 0.3871 | 0.7737 |
| 0.7368 (14/19) | 6.21 | 0.0096 | 0.3818 | 0.7511 |
| 0.74 | 6.04 | 0.0099 | 0.3841 | 0.7411 |
| 0.75 | 5.75 | 0.0100 | 0.3729 | 0.7128 |
| 0.8 | 4.2 | 0.0080 | 0.2739 | 0.5176 |

The probability of alarm under $p_1$ should be as large as possible, when the probability of alarm under $p_0$ is fixed. In this respect, it is clear that K=2/3 is better than all other choices of K, because it has smaller probability of alarm under the acceptable proportion and higher probability under the alternative (100 events). Only for K=0.8, this superiority cannot be proved, because both probabilities are lower. This documents that K=$p_0$ is optimal in this regard.

For comparison purposes Table 3 reflects properties of the designs of Table 2. Table 3 lists the mean time to alarm for these designs, and the standard deviation for $p_0$.

TABLE 3

| K | H | Mean time to alarm. p = ⅔ ($ARL_0$) | Mean time to alarm. p = ¾ ($ARL_1$) | Standard deviation for time to alarm. p = ⅔ |
|---|---|---|---|---|
| ⅔ | 9.67 | 444.8 | 68.8 | 359.5 |
| 0.7 | 7.9 | 919.7 | 72.9 | 853.1 |

TABLE 3-continued

| K | H | Mean time to alarm. p = ⅔ ($ARL_0$) | Mean time to alarm. p = ¾ ($ARL_1$) | Standard deviation for time to alarm. p = ⅔ |
|---|---|---|---|---|
| 0.72 | 6.88 | 1342.7 | 76.1 | 1288.6 |
| 0.73 | 6.43 | 1607.2 | 78.8 | 1558.2 |
| 0.7368 (14/19) | 6.21 | 1853.4 | 81.6 | 1807.2 |
| 0.74 | 6.04 | 1905.9 | 82.3 | 1861.5 |
| 0.75 | 5.75 | 2195.0 | 86.2 | 2154.9 |
| 0.8 | 4.2 | 4143.9 | 126.3 | 4116.9 |

There is a dramatic increase in mean time to alarm, with K. This is because the standard deviation increases with K from about 81 to 99% of the mean, and thus as the 1% fractile is fixed, markedly higher mean values are needed. These evaluations count towards using a low value of K, but unfortunately this choice is less robust towards the expected number of adverse events. This is illustrated in two ways. First, how dependent is H on the expected incidence. If K=2/3 is used and the incidence is 3 and 10 times higher, the value of H should be 17.33 and 32, respectively. If K is chosen to be 0.74, the corresponding numbers are 8.34 and 10.46. This shows that H is less dependent on the incidence for K=0.74. Second, the point is illustrated by considering various values for the incidence, when H is fixed to the values in Table 2.

The probability of false alarm is shown in Table 4. Table 4 shows sensitivity towards the number of adverse events, when H is chosen to have probability less than 0.01 at 60 events, p=2/3, and c=0:

TABLE 4

| K | H | Probability of alarm within 30 events. | Probability of alarm within 120 events. | Probability of alarm within 180 events. |
|---|---|---|---|---|
| ⅔ | 9.67 | 0.000005 | 0.101 | 0.227 |
| 0.7 | 7.9 | 0.00010 | 0.062 | 0.124 |
| 0.72 | 6.88 | 0.00021 | 0.050 | 0.093 |
| 0.73 | 6.43 | 0.00037 | 0.045 | 0.081 |
| 0.7368 (14/19) | 6.21 | 0.00037 | 0.040 | 0.071 |
| 0.74 | 6.04 | 0.00037 | 0.040 | 0.070 |
| 0.75 | 5.75 | 0.00061 | 0.036 | 0.063 |
| 0.8 | 4.2 | 0.0013 | 0.022 | 0.036 |

Clearly, the probability is rather dependent on the incidence for low K values, and less so for high K values. The probability of 22.7% of stopping early if the incidence is three times larger than was believed is unacceptably high.

One property of these distributions is that there is a lower bound for the range. For example, in the case where K=2/3, at least 29 events are needed to give an alarm, and in the case where K=0.74, at least 24 events are needed. This is, however, measured on the event time scale. If there is a markedly increased risk, these events will develop fast, measured in calendar time.

Figure 6:
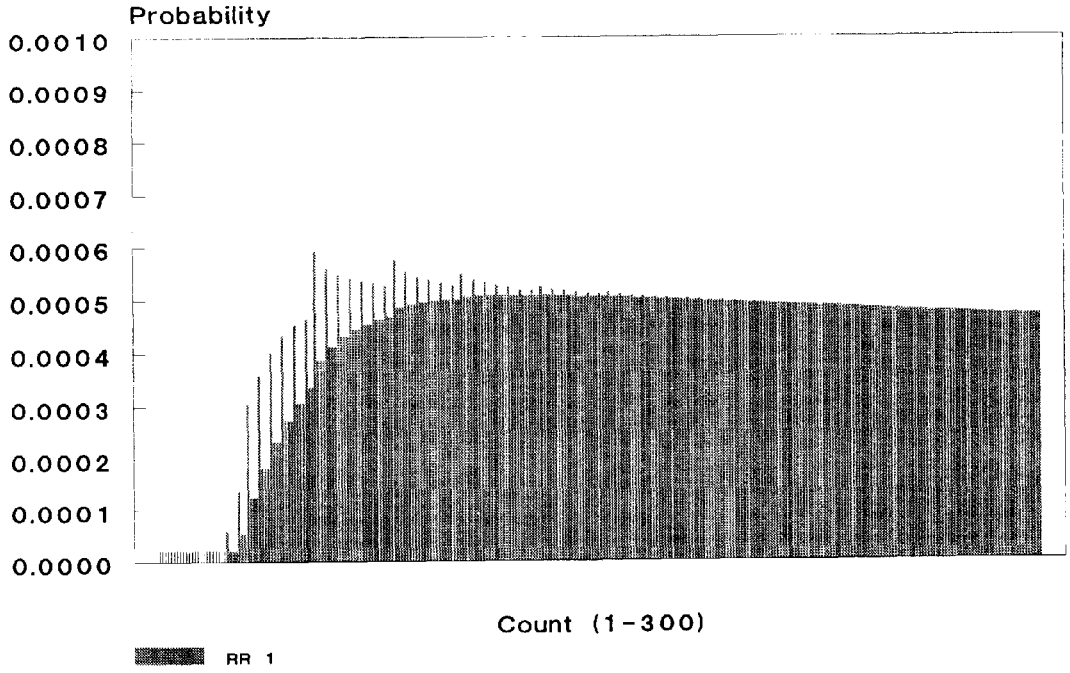
FIG. 6 is a bar chart showing the exact probabilities corresponding to K=0.74, H=6.04, c=0, p=2/3, for a number of events up to 300.

Based on these evaluations a value of K=0.74 was chosen as a simple value close to the optimal with respect to ARL. It follows that H must be 6.04. Technically 14/19 should be closer to the optimal, but it was judged difficult to explain to people that everything was counted in fractions with denominator 19. The distribution is shown in FIG. 6. The distribution is quite irregular, as a consequence of the discreteness.

Figure 7:
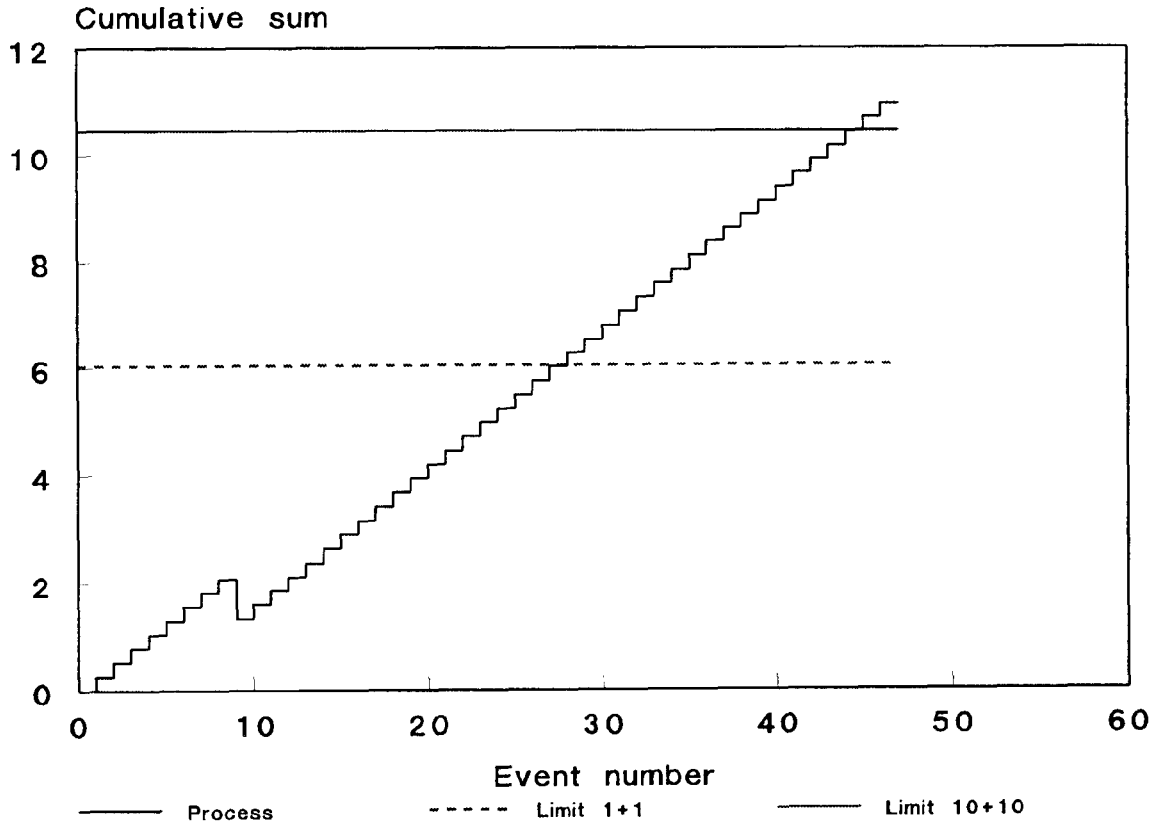
FIG. 7 shows the CUSUM process for prolapses and incontinence in the phase III trials of NNC 46-0020.

Due to the focus on these events, a number of adverse events were reported each day, and safety committee meetings were held each week. FIG. 7 shows the CUSUM process as it was presented at the committee meeting, where the limit was passed. At this time, the process had passed not only the limit corresponding to the incidence of 1% of each type of adverse event, but also the limit corresponding to an incidence of 10%. Such "overrunning" seems to be unavoidable for multi-center studies. The distribution 44 to 1 corresponds to a relative risk of 22 for NNC 46-0020. The safety committee recommended that the studies were terminated and a few days later, the management reached a decision adopting that recommendation. The trials were terminated and a final analysis made. This analysis confirmed that there was an increased risk of prolapses and incontinence, although the relative risk estimate was reduced.

It is noted that these occurrences could not have been detected earlier—phase II testing did not give any clue.

Example 2 NovoSeven Study F7Liver-1252

The present invention also has been used to evaluate a drug known as F7Liver-1252, also referred to herein as Factor 7.

Among the adverse effects of concern in this study were thrombo-embolic events such as portal vein thrombosis, hepatic arterial thrombosis, DVT (Deep Vein Thrombosis), PE, AMI (Myocardial Infarction) and DIC.

In this phase II study the risk of false alarm was estimated to be at most 1%, within the events (the number of adverse events is assumed Poisson distributed with mean 8), when there is no difference in risk. The expected number of adverse events (8) is found by assuming 80 patients and an incidence of 10%/transplantation for thrombo-embolic events.

As a design alternative: the value of the parameter K was chosen to be 5/6, which is close to the optimal (with respect to average run length), when the alternative is a relative risk of 3 for the tested NovoSeven drug as compared to the placebo.

The smallest value of H satisfying these criteria is 2.

Thus the suggested scheme has K=5/6 and H=2.

As with the previous example, the suggested procedure is a cumulative sum (CUSUM) approach. It is started at 0. It is to be updated each time a new adverse event is reported. If the event is in the treatment group, 1 is added, otherwise 0. Then a chosen quantity K is subtracted. This K serves the role as a correction for the expected increase, although it does not need to be identical to the expected value. In fact, the performance of the approach can be improved by choosing a higher value. If the cumulated value is negative, the process is set to 0. If the value crosses a chosen limit H, this is considered to be an alarm, suggesting an increased risk in the active treatment group. The parameters K and H determine the specifications of the approach, and should be chosen accordingly.

Again, in mathematical terms, the procedure can be written in the following way, where i is the event number and $S_i$ denotes the cumulative sum:

$$S_0=0$$

$$S_i=\max\{0,S_{i-1}+N_i-K\},\ i=1,2,\ldots$$

where $N_i$ is the indicator function of the ith event being in the treatment group. The alarm event is the first event number (i) with $S_i \geqq H$.

This approach is completely internal to the study in the sense that the relative distribution between the active treatment and the placebo group is studied. However, the expected number of events (applicable if all patients receive placebo) is needed in order to choose a sensible value of H (that is, one with a small risk of false alarm).

It could be suggested that the value of K were equal to the expected value, in this case the randomization proportion 3/4, as it optimizes the probability of alarm within the expected number of events during the study. However, the expected number of events is a function of the incidence of the adverse events among the control group, and this is not known very well, because here literature values are almost unavailable for the present drug being studied.

Accordingly, a value of K=5/6 was chosen. This value was selected because the asymptotically optimal value, when the relative risk is 3, and the optimality criterion instead is the mean number of events to alarm (average run length), is K≈0.8340. From a computational point of view, it is, however, easier to use a simple fraction. In practice, there is no loss in applying the simple value 5/6 instead of the asymptotically optimal value.

Besides being optimal with respect to the average run length criterion, using K=5/6 instead of 3/4 turns out to give a procedure which is less sensitive to the assumed incidence (10%). As this value is not well determined, it is preferable to use the more robust approach.

As already noted, the adverse events were considered to be thrombo-embolic events, and more specifically, portal vein thrombosis, hepatic arterial thrombosis, deep vein thrombosis, PE, myocardial infarction and DIC. These adverse events were combined due to the hypothesis of common patho-fysiology. Furthermore, due to the low numbers of events, it would not make sense to use separate CUSUM schemes for each type of event. Patients showing several types of adverse events, or repeated cases of the same type of event, count as having a single event (the first).

The drug being tested, NovoSeven, was studied in 3 different doses, 20, 40 and 80 μg/kg. Each dosing level included 20 patients. The surveillance scheme did not account for the dose applied.

The placebo group is similarly designed to include 20 patients.

Design alternative.

As explained above, the value of the parameter K was chosen to be 5/6, which is close to the optimal (with respect to average run length), when the alternative is a relative risk of 3 for NovoSeven compared to placebo.

The risk of false alarm should be at most 1% within the expected number of adverse events, if all patients were receiving the placebo. This value has been chosen instead of 5%, because there is a chance of suggesting other adverse events later that should be monitored, and if several types of adverse events are each given a probability of false alarm of 5%, the total risk that the study would appear to have, even when there is no increase, would be too high. As the distribution is discrete, the probability cannot be obtained precisely, and therefore the value chosen is the smallest value of H satisfying that the probability of false alarm is below 1% within the expected number of events. The expected number of events is so low in this case and therefore it is assumed that the number of events is Poisson distributed. This allows for the fact that the number of events is not predetermined. Specifically, this is done by evaluating the probabilities of after any number of events up to some limits and then these probabilities are mixed according to the Poisson distribution. This allows for the fact that the number of events is not predetermined. Specifically, this is done by evaluating the probabilities of after any number of events up to some limits and then these probabilities are mixed according to the Poisson distribution.

When there is no difference in risk, and all patients have the risk of the placebo group, 8 events are expected. This is determined by means of the following. The study consists of 80 participants. The placebo incidence of thrombo-embolic events is estimated as 10%, or the slightly more formal 0.1/transplantation. As the events are acute events related to the time of transplantation, the incidence is measured per transplantation rather than related to the time of follow up (corresponding to a unit including patient by time in the denominator).

According to these considerations, the smallest satisfactory value of H is H=2.

The probability of a false alarm within the events (coming as Poisson with mean 8) is 0.0046. This is clearly below 1%. The reason for this is that if a lower value (that is 1 5/6) is chosen, the risk would be 0.0104. No choices are relevant in between these values.

The average run length is 95.8 adverse events.

If the relative risk is 3, then one would expect 3×10%×60=18 patients with events in the treatment group and 10%×20=2 patients with events in the placebo group. This would imply an expected number of 20 events, distributed with 90% in the treatment group. In this case, the probability of obtaining an alarm is 0.563.

The average run length is 21.7 adverse events.

As the chosen incidence is crucial for setting the specifications, it has been examined how the limits would change if different choices were made for the incidence under the hypothesis that there is no difference between the drug being tested, NovoSeven, and the placebo. Values of 5%, 15% and 25% are considered. The results are given in Table 5 below, which depicts a sensitivity analysis of the surveillance scheme:

TABLE 5

| Background incidence (per transplantation) | Expected number of events during the study (under placebo risk) | Risk of false alarm | Expected number of events during the study (under the alternative risk) | Risk of alarm under the alternative |
|---|---|---|---|---|
| 5% | 4 | 0.000032 | 10 | 0.102 |
| 15% | 12 | 0.029 | 30 | 0.808 |
| 25% | 20 | 0.108 | 50 | 0.964 |

It follows from Table 5 that if the true placebo incidence of thrombo-embolic events is 5%, instead of 10%, it is very unlikely that there will be a false alarm. It is also unlikely (probability 0.102) that an alarm will be observed under the design alternative. This is to some extent undesirable, but overall, this is considered to be acceptable, because it implies that the adverse events are not as common as had been expected.

If the true placebo incidence of thrombo-embolic events is 15% instead of 10%, the probability of a false alarm is 0.029. It is unavoidable that it is higher than the value for 10% incidence, but it is still low and therefore acceptable. The probability of obtaining an alarm under the design alternative is 0.808.

As an alternative value for K, one can consider 3/4 as the proportion treated with the tested drug. Assuming a background incidence of 10%/transplantation, the value of H should be 3. The risk of false alarm is 0.0048 and the risk of alarm under the alternative is 0.667. Thus this design is more effective (according to the probability of alarm) in detecting an increased risk, because the value under the alternative is higher than 0.563 (the value for K=5/6).

The average run length is 57.5 adverse events. This is clearly lower than the value 95.8 for K=5/6. In other words, this means that if more events appear, for example, if the real rate is much higher than the rate in the study, there will be a high risk of false alarm. This means that the design is more sensitive to the choice of expected incidence than for K=5/6. This is illustrated in Table 6, which shows a comparison of the sensitivity for K=3/4 and 5/6:

TABLE 6

| Background incidence (per transplantation) | Risk of false alarm (K = ¾) | Risk of false alarm (K = ⅚) |
|---|---|---|
| 5% | 0.000032 | 0.000032 |
| 10% | 0.0048 | 0.0046 |
| 15% | 0.034 | 0.029 |
| 25% | 0.152 | 0.108 |

From this it can be seen that if the true incidence is much higher than the one expected according to the literature, there is a high risk of false alarm in the case K=3/4. For K=5/6, the risk may still be high, but it is not as bad as for K=3/4.

As a consequence of this approach, it is impossible to obtain an alarm before there are 12 thrombo-embolic events. If there are 12 events and these are all on Factor VII, there will be an alarm. If there is just a single event in the placebo group, more events are necessary to obtain an alarm. It might appear surprising to need so many events even if they are all on the drug. The reason is that the study is designed to yield information on Factor VII, and correspondingly only a few patients (¼ of the participants) are actually on the placebo. If there are 12 events and treatment has no influence on the risk of thrombo-embolic events, then 9 events would be expected in the treatment group and 3 in the placebo group. In this light, the 12-0 distribution means that there are 3 more in the treatment group than expected. This is a more proper account of the distribution than what appears from just quoting that all events are on the active drug.

However, a slightly different interpretation is that the need for such extreme distributions as the 12-0 in order to generate an alarm, is the desire to make a comparison, which is completely internal to the study, and thus suffers from the limited experience in the placebo group. Alternatively (or as a supplement), one can compare to external values (values expected from the literature or based on past clinical experience). This implies that if there is a reasonable number of events (more than expected) for the active treatment group and the cases appear to be drug related, this can be reported as a separate finding.

Further developments and modifications of this invention now will be described.

The foregoing surveillance program can include more advanced features.

By way of nonlimiting example, the CUSUM process can be evaluated for each new serious adverse event. Further, the procedure could be modified to perform the evaluation for each n events, where n is a positive integer of at least 1. This would improve the performance for local alternatives, although there would be some delay for large differences in risk. The only modification is that the distribution of $N_i$ is no longer Bernoulli, but a binomial distribution with parameters n and p.

One practical solution may be to update the analysis each week, corresponding to a random value of n. While this complicates calculations, one might use a fixed n value as a first approximation. Another and better approximation is to choose $H_1$>H, and then evaluate $G^n$ for the process with limit $H_1$ for all values of n up to $n_1$, say. These matrices are then mixed over n according to the Poisson distribution of number of events during the week. This is then used to evaluate a transition matrix for a week. The columns covering states H to $H_1$ are substituted by their sum. The rows for these states are substituted by a row corresponding to H being absorbing.

The performance of the various parameter values has been evaluated at the expected number of events during phase III, 60 or 100 events for the application. However, it is well known that this number is not fixed in advance. It is possible to introduce random variation in the number of adverse events, most natural, by assuming a Poisson distribution. This is easily done in the exact calculations, as the full distribution is known; this can just be mixed over the Poisson.

Table 7 depicts the probabilities of alarm, when the number of events is assumed to be Poisson distributed with mean 60. Table 7 shows the effect of using a Poisson distribution for the number of adverse events, c=0:

TABLE 7

| K | H | Probability of alarm when the number of events is Poisson distributed with mean 60 events p = ⅔ | H so that probability is below 0.01 | Probability of alarm. when the number of events is Poisson distributed with mean 60 events. p = ⅔ |
|---|---|---|---|---|
| ⅔ | 9.67 | 0.0099 | 9.67 | 0.0099 |
| 0.7 | 7.9 | 0.0096 | 7.9 | 0.0096 |
| 0.72 | 6.88 | 0.0102 | 6.92 | 0.0099 |
| 0.73 | 6.43 | 0.0099 | 6.43 | 0.0099 |
| 0.7368 (14/19) | 6.21 | 0.0097 | 6.21 | 0.0097 |
| 0.74 | 6.04 | 0.0101 | 6.06 | 0.0099 |
| 0.75 | 5.75 | 0.0101 | 6.00 | 0.0073 |
| 0.8 | 4.2 | 0.0080 | 4.2 | 0.0080 |

The alarm probabilities under $p_0$ are generally slightly higher than those of Table 2. This is because the cumulative distribution is approximately convex in this part of the distribution. It is not exactly convex, due to the irregularity of the distribution. In the cases, where this probability exceeds 0.01, H has been increased to lower this probability. In some cases H needs to be increased to the next possible value for the probability to be below 0.01. Thus for the present study, it has only little effect in practice to account for the randomness of the total number of events. However, in other cases, where the expected number of events is smaller, it makes sense to account for the random variation in the number of adverse events.

It seems more important whether there are systematic errors in the total number of events, that is, whether the incidence considered is correct for the trial population. This is may be a point of concern in the whole approach. If the true incidence is lower than expected, the chance of getting an alarm is lower than requested. Also it is more difficult to detect a difference between the treatment groups. This is undesirable, but as the condition overall makes a smaller problem than expected, it may be acceptable. If the true incidence is higher than expected, there may be more of a problem, the adverse condition is rather frequent, and it is more difficult to judge whether an alarm is false or true because the risk of a false alarm is so large that it cannot be neglected in practice. As shown above, choosing K appropriately reduces the problem, both when the incidence is smaller and larger than expected. This means that even though some optimality results have been described for $K=p_0$, this choice is not recommended. A pragmatic solution is to take the optimal value for the ARL using a sensible alternative value for the relative risk.

There is only little experience with the choice of c. Taking c=0 is a simple choice. A negative c allows for better specifications when they are based on mean values. However, it will be more difficult to detect a problem that is not present initially, but develops suddenly or gradually. Whether a negative c is an advantage in terms of the probability of early stopping is a more difficult problem, as is shown in Table 8.

Table 8 reflects design choices with $p_0=2/3$, $p_1=4/5$, K=0.74, and H being the smallest value satisfying that the probability of alarm within 60 events under $p_0$ is below 0.01:

TABLE 8

| c | H | Probability of alarm within 60 events. p = ⅔ | Probability of alarm within 60 events. p = ⅘ | Probability of alarm within 100 events. p = ⅘ |
|---|---|---|---|---|
| 0 | 6.04 | 0.0099 | 0.3841 | 0.7411 |
| −1 | 5.42 | 0.0097 | 0.4096 | 0.7390 |
| −2 | 5.20 | 0.0098 | 0.4148 | 0.7214 |
| −5 | 5.12 | 0.0099 | 0.4142 | 0.7054 |

A negative lower limit is advantageous, when the alternative expected number of patients is 60, but not when it is 100. This is due to the long tail of the distribution.

If there is an increased risk with a new preparation, it is of interest whether it applies to the whole patient population, or just a subset of it. The present approach is designed for a generally increased risk, and for unsuspected adverse events. If there are more specific hypotheses regarding subsets, this should be built directly into the approach. It is likely that too much precision would be lost by allowing for an unspecific differential increase in risk.

It is found that the optimal value is $K=p_0$, when the probability of alarm within a fixed period is used as criterion. In the case of NNC 46-0020, discussed above, the optimal K (ARL)≈0.7370.

Incidentally, after a study of the standard Poisson CUSUM, it has been found that the results on the differential optimum carry over to this case, so that studying the probability of alarm within a fixed time frame leads to the optimum being found at $K=\lambda_0$.

One further problem is ascertainment bias. In many cases, the suspicion that a specific type of adverse event is over-represented is based on the first observations in the same trials. The calculations described above are based on an assumption that the suspicion came from another source. It is technically correct to disregard the first observations to avoid the ascertainment bias, but in practice, it may be preferable to include them, even though it implies that the probability of stopping early is higher than intended. This is done, of course, in order to reduce the risk of harming the patients.

Figure 2:
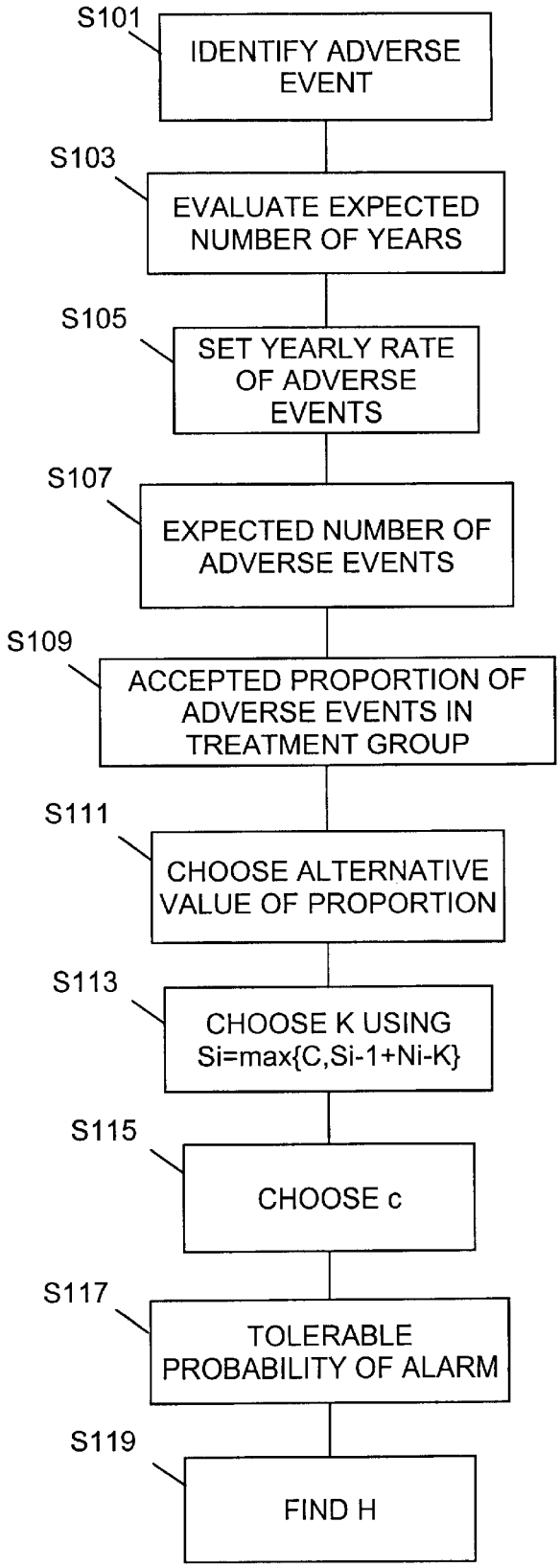
FIG. 2 depicts a method for administering a clinical surveillance program.

To set up a surveillance program in accordance with this invention, and with reference now to FIG. 2, the following steps are proposed:

Step S101. Decide which diagnoses should be included in the surveillance program.

Step S103. Evaluate the expected number of years of observation in the trials, say T.

Step S105. Suggest a rate per year of serious adverse events, say β. This might be based on the literature, or estimated by an expert.

Step S107. Find the expected number of serious adverse events, Tβ.

Step S109. Choose the accepted proportion of total serious adverse events in the treatment group. In almost all cases this is the proportion randomized to the treatment.

Step S111. Choose an alternative value of the risk, and in step S113, choose K as a rational number near the value found in formula (2), $K=-[\log\{(1-p_0)/(1-p_1)]\}/\log[p_0(1-p_1)/\{p_1(1-p_0)\}]$.

Step S115. Choose c. A first choice should be c=0, but a negative c may be considered.

Step S117. Decide what probability of alarm is tolerable, if there is no difference between the two groups.

Step S119. Find the lowest H, with a probability below that chosen in step S117.

Steps S103 and S105 are only used to find-the expected number of serious adverse events in step S107. Therefore if the latter number is known, it is not necessary to decide separately on T and β.

The value of K may be chosen differently than in step S113 depending on which optimality criterion is used, and on the degree of certainty in the knowledge on the incidence.

Although the foregoing explanation of the preferred embodiments of this invention discusses the clinical surveillance of phase III drug testing, this invention is not to be limited thereto. It is envisioned that the concepts taught herein could be applied to the surveillance of any test program where it is desirable to monitor for adverse occurrences that might necessitate ending or modifying the testing program, both drug-based and otherwise.

Thus, while there have been shown and described and pointed out novel features of the present invention as applied to preferred embodiments thereof, it will be understood that various omissions and substitutions and changes in the form and details of the disclosed invention may be made by those skilled in the art without departing from the spirit of the invention. It is the intention, therefore, to be limited only as indicated by the scope of the claims appended hereto. In particular, the term "serious" has been used above by way of example only and not limitation, and this invention is equally applicable to the monitoring of non-serious adverse events.

It is also to be understood that the following claims are intended to cover all of the generic and specific features of the invention herein described and all statements of the scope of the invention which, as a matter of language, might be said to fall there between. In particular, this invention should not be construed as being limited to the values disclosed herein.

What is claimed is:

1. A method for clinical surveillance of a treatment group and an other group, comprising the steps of:

defining a type of an adverse event;

noting each occurrence of the defined adverse event;

obtaining a value by;

calculating, starting at zero, a cumulative sum of the noted adverse events by;

updating the cumulative sum each time a further adverse event is noted; and when the noted adverse event is in the treatment group, adding 1 to the cumulative sum, and when the noted adverse event is in the other group, adding 0 to the cumulative sum;

subtracting a chosen quantity K from the cumulative sum; comparing the cumulative sum to a predetermined alarm limit; and determining when the cumulative sum reaches at least the predetermined alarm limit.

2. A method for clinical surveillance according to claim 1, further comprising the step of indicating the predetermined alarm limit has been reached.

3. A method for clinical surveillance according to claim 1, wherein in the step of defining, plural types of adverse events are defined.

4. A method for clinical surveillance according to claim 1, wherein the predetermined alarm limit has a value H chosen to obtain a low risk of a false alarm where there is no safety problem.

5. A method for clinical surveillance according to claim 1, wherein the cumulative sum of the adverse events is determined using a formula $$S_i=\max\{c,S_{i-1}+N_i-K\},\ i=1,2,\ldots$$

where $S_i$ is the cumulative sum, $S_0=0$, and $N_i$ is an indicator function of an ith event occurring in the treatment group.

6. A method for clinical surveillance according to claim 5, wherein an alarm event is a first event number (i) such that $S_i \geqq H$.

7. A method for clinical surveillance according to claim 5, wherein c is a chosen constant and $-\infty \leqq c \leqq 0$.

8. A method for clinical surveillance according to claim 1, further comprising a step of unblinding those participants experiencing the adverse events when the cumulative sum reaches the predetermined alarm limit.

9. A method for clinical surveillance according to claim 1, wherein the step of calculating is performed for less than all of the adverse events.

10. A method for clinical surveillance according to claim 1, wherein the step of calculating is performed for each n adverse events, n being an integer having a value of at least 1.

11. A method for clinical surveillance according to claim 1, wherein the step of calculating is performed at regular intervals.

12. A method for clinical surveillance according to claim 1, wherein the step of calculating is performed at random intervals.

13. A computer-readable storage medium having a program for performing the method of claim 1.

14. A method for administering a clinical surveillance program to a treatment group and an other group, comprising the steps of:

identifying an adverse event to be monitored in the clinical surveillance program;

evaluating an expected number of years of observation for trials;

setting a rate per year of the adverse events;

determining an expected number of the adverse events;

choosing an accepted proportion of the adverse events that may be in the treatment group;

choosing an alternative value of the proportion in the treatment group;

choosing K as a number near a value found in a formula $K=-[\log\{(1-p_0)/(1-p_1)\}]/\log[p_0(1-p_1)/\{p_1(1-p_0)\}]$.

choosing c;

deciding what probability of alarm is tolerable, if there is no difference between the treatment group and the other group; and finding a lowest H with a probability which is less than that determined in the step of deciding.

15. A method for administering a clinical surveillance program according to claim 14, wherein in the step of setting the rate per year of adverse events, the rate is obtained from literature.

16. A method for administering a clinical surveillance program according to claim 15, wherein in the step of setting the rate per year of adverse events, the rate is obtained as an estimate by an expert.

17. A method for administering a clinical surveillance program according to claim 15, wherein the value of K is chosen according to an optimality criterion, and a degree of certainty in a knowledge on the incidence.

18. A method for administering a clinical surveillance program according to claim 15, further comprising the step of unblinding those participants experiencing adverse effects when value of H is reached.

19. A computer-readable storage medium having a program for performing the method of claim 15.

20. A method for administering a clinical surveillance program according to claim 15, wherein the value of K is chosen as being at least equal to p0.

* * * * *